US011081298B2

(12) United States Patent
Cheng et al.

(10) Patent No.: US 11,081,298 B2
(45) Date of Patent: Aug. 3, 2021

(54) KEY STRUCTURE

(71) Applicant: CHICONY ELECTRONICS CO., LTD., New Taipei (TW)

(72) Inventors: Chi-Hung Cheng, New Taipei (TW); Chia-Hsin Chen, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/553,772

(22) Filed: Aug. 28, 2019

(65) Prior Publication Data

US 2020/0335289 A1 Oct. 22, 2020

(30) Foreign Application Priority Data

Apr. 16, 2019 (TW) ..... 108113179

(51) Int. Cl.
*H01H 13/14* (2006.01)

(52) U.S. Cl.
CPC ..... *H01H 13/14* (2013.01)

(58) Field of Classification Search
CPC ..... H01H 13/14; H01H 13/78
USPC ..... 200/5 A, 341
See application file for complete search history.

(56) References Cited

U.S. PATENT DOCUMENTS 6,057,522 A * 5/2000 Chao ..... H01H 3/122 200/341
6,225,586 B1 5/2001 Watanabe et al.

FOREIGN PATENT DOCUMENTS

TW 337873 * 8/1998 ..... G06F 3/023
TW 337873 U 8/1998
TW M551337 * 11/2017 ..... H01H 13/78
TW M551337 U 11/2017

* cited by examiner

*Primary Examiner* — Edwin A. Leon
*Assistant Examiner* — Iman Malakooti
(74) *Attorney, Agent, or Firm* — Muncy, Geissler, Olds & Lowe, P.C.

(57) ABSTRACT

A key structure includes a keycap, a guiding structure, a connection member and a base plate. The guiding structure is located below the keycap and includes at least one pivot shaft. The connection member includes a connection groove, and the at least one pivot shaft is connected to the connection groove. The base plate includes at least one fixing member. The connection member envelops the at least one fixing member such that the connection member is fixed to the base plate.

4 Claims, 8 Drawing Sheets

KEY STRUCTURE

FIELD OF THE INVENTION

The present invention relates to a keycap structure and, more particularly, to a keycap structure capable of reinforcing the structural strength between a guiding structure and a base plate.

DESCRIPTION OF THE PRIOR ART

With constant improvements in technology, electronic products have become indispensable tools to modern people. With regard to the habits of use of computer users, keyboards are essential input tools. A conventional membrane keyboard, for instance, is composed of components including a keycap, a guiding structure, a membrane circuit and a base plate. When a user hits a keycap, the keycap is guided by the guiding structure to move down and triggers the membrane circuit so as to generate an input signal. If the overall structural strength of the keys thereof is insufficient, shaking or shifting of the keys can result, causing a poor hand feel when the keys are hit by a user. Alternatively, before being shipped out of the factory, if such keyboard products fail to pass quality control inspection because the guiding structure is not securely joined with the base plate, waste and consequent increases in production costs can result.

For example, U.S. Pat. No. 6,225,586 discloses a technology in which a fixing member is additionally provided on a base plate to fix a pivot shaft of a guiding structure. However, due to the demand for thin and lightweight keyboards, even if the base plate becomes thinner and is additionally provided with a fixing member, the fixing member cannot be securely joined with the base plate because of the small overall thickness of the base plate as well as the insufficient joining strength between the fixing member and the base plate, which results in an insufficient joining strength between the guiding structure and the base plate. The abovementioned issues of shaking of the keys or failure to pass quality control inspection can still result. Therefore, there is a need for a solution to the above issues.

SUMMARY OF THE INVENTION

It is a primary object of the present invention to provide a key structure capable of reinforcing the structural strength between a guiding structure and a base plate.

To achieve the above object, a key structure of the present invention includes a keycap, a guiding structure, a connection member and a base plate. The guiding structure is located below the keycap and includes at least one pivot shaft. The connection member includes a connection groove, and the at least one pivot shaft is connected to the connection groove. The base plate includes at least one fixing member, and the connection member envelops the at least one fixing member such that the connection member is fixed to the base plate.

With a fitting force between the fixing member and the connection member, the structural strength between the guiding structure and the base plate is reinforced, thus maintaining the joining stability between the pivot shaft of the guiding structure and the connection groove, minimizing the occurrence of shaking or shifting of the key when the keycap is hit.

DETAILED DESCRIPTION OF THE EMBODIMENTS

To enable the Examiner to better understand the technical contents of the present invention, preferred embodiments are described in detail below.

Figure 1:
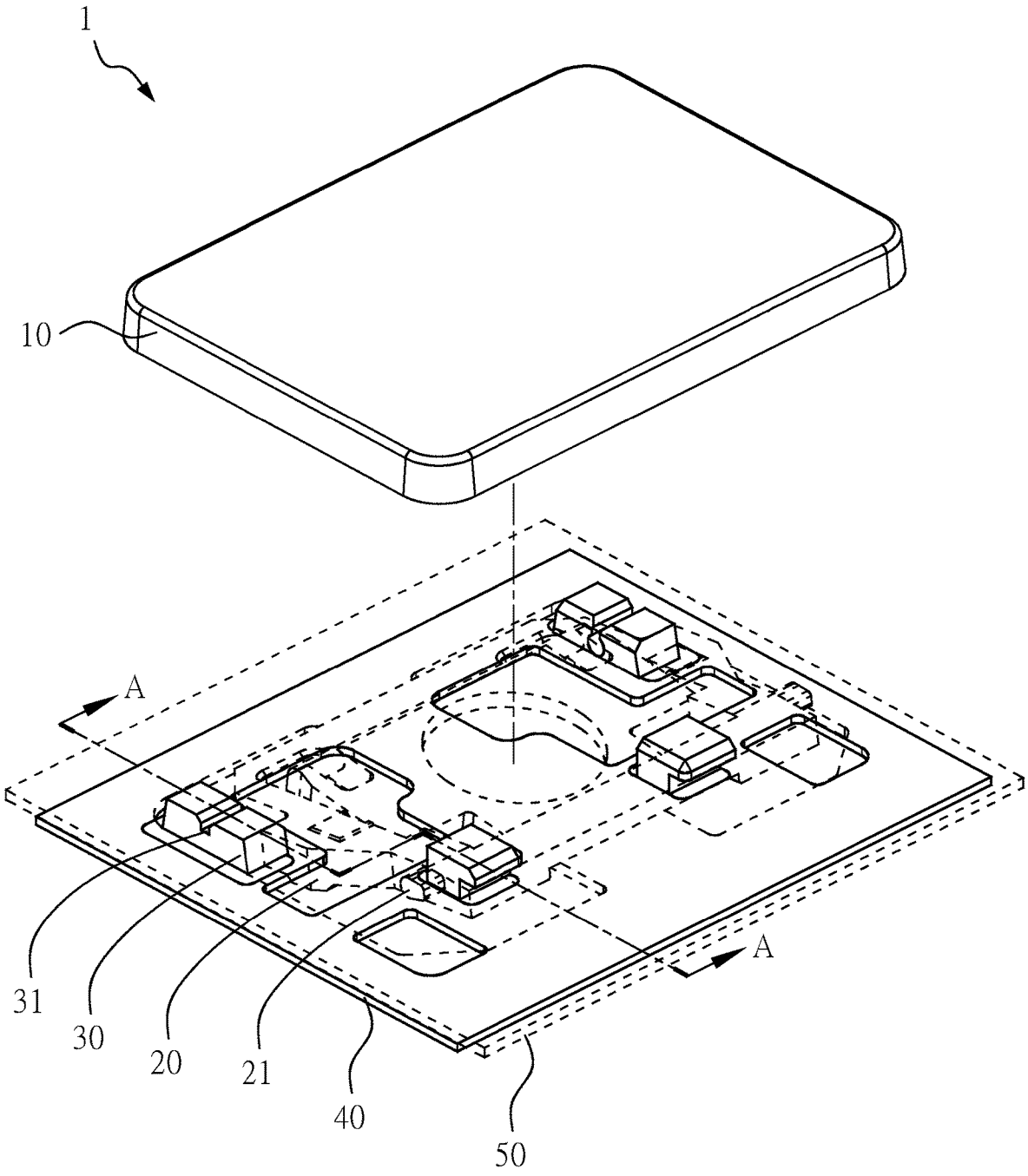
FIG. 1. is a schematic diagram of a key structure according to a first embodiment of the present invention.

Refer to FIG. 1, FIG. 2, FIG. 3A and FIG. 3B for a schematic diagram, an exploded structural diagram, a cross-sectional diagram along the section line AA in FIG. 1 and a cross-section diagram of a key structure according to a first embodiment of the present invention.

As shown in FIG. 1, FIG. 2, FIG. 3A and FIG. 3B, in this embodiment, a key structure 1 of the present invention includes a keycap 10, a guiding structure 20, a connection member 30, a base plate 40 and a circuit board 50. The guiding structure 20 is located below the keycap 10 and includes at least one pivot shaft 21. The connection member 30 includes a connection groove 31, and the at least one pivot shaft 21 is connected to the connection groove 31, thereby fixing the guiding structure 20. The circuit board 50 is located between the base plate 40 and the guiding structure 20. The base plate 40 includes at least one fixing member 41 embedded in the connection member 30. When the guiding structure 20 drives the keycap 10 to move up and down relative to the base plate 40, the overall structural strength of the key structure 1 is reinforced by means of a binding force by which the fixing member 41 is embedded in the connection member 30, such that the guiding structure 20 is not easily disengaged from the base plate 40 and the joining stability between the pivot shaft 21 of the guiding structure 20 and the connection groove 31 is maintained, thus minimizing the occurrence of shaking or shifting of the key when the keycap 10 is hit. It should be noted that, in this embodiment, the fixing member 41 is embedded in the connection member 30 by means of injection molding; that is, the connection member 30 completely envelops the fixing member 41, and the fixing member 41 and the base plate 40 are integrally formed and joined by means of stamping.

Figure 2:
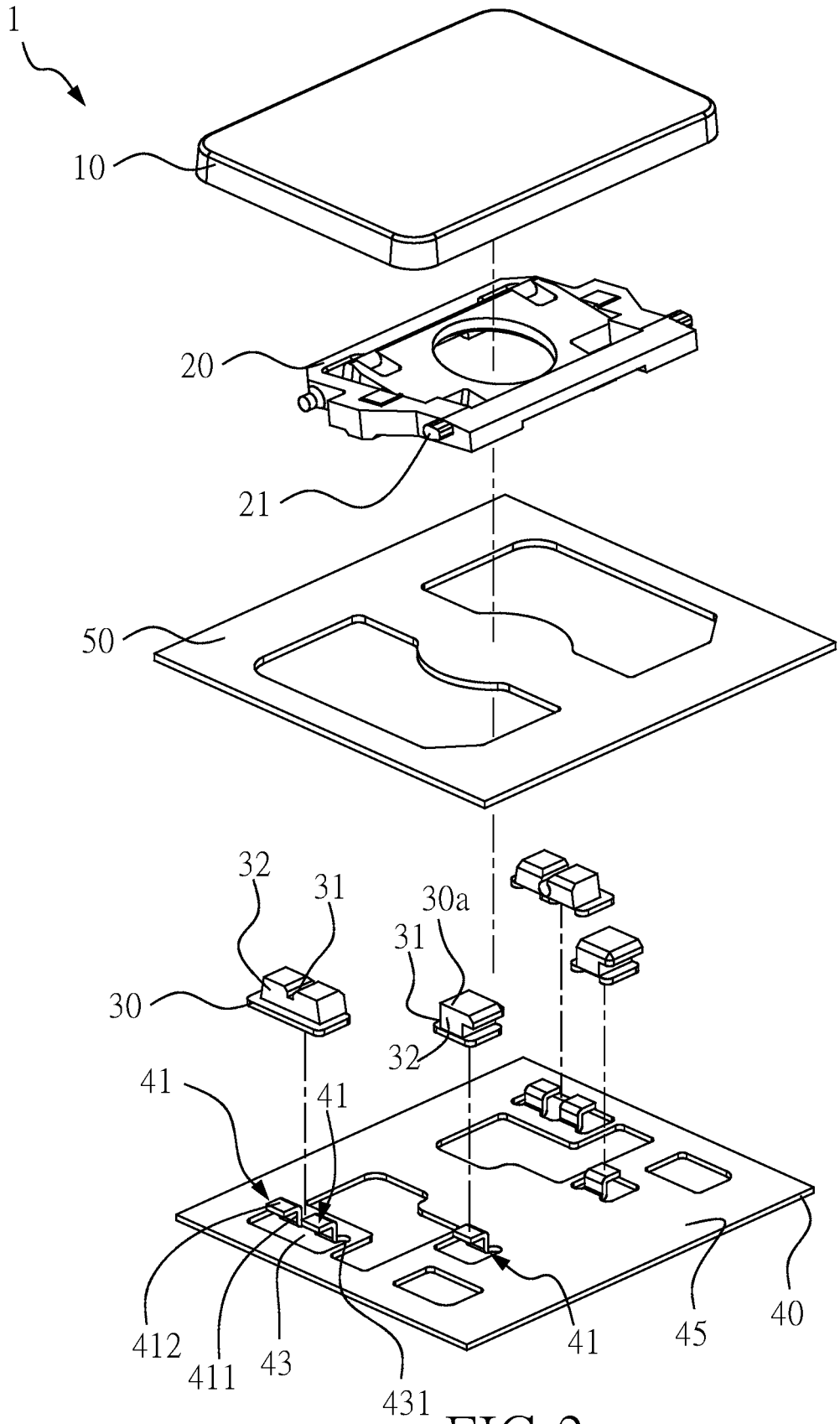
FIG. 2 is an exploded structural diagram of a key structure according to the first embodiment of the present invention.
Figure 3A:
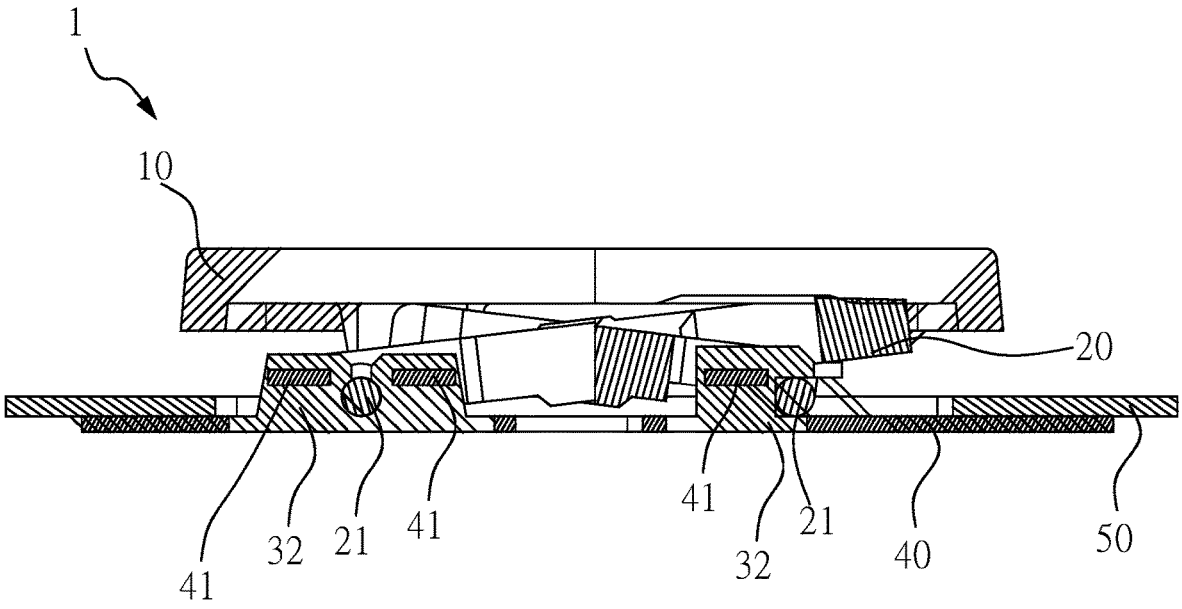
FIG. 3A is a cross-sectional diagram of a key structure along a section line AA in FIG. 1 according to the first embodiment of the present invention.
Figure 3B:
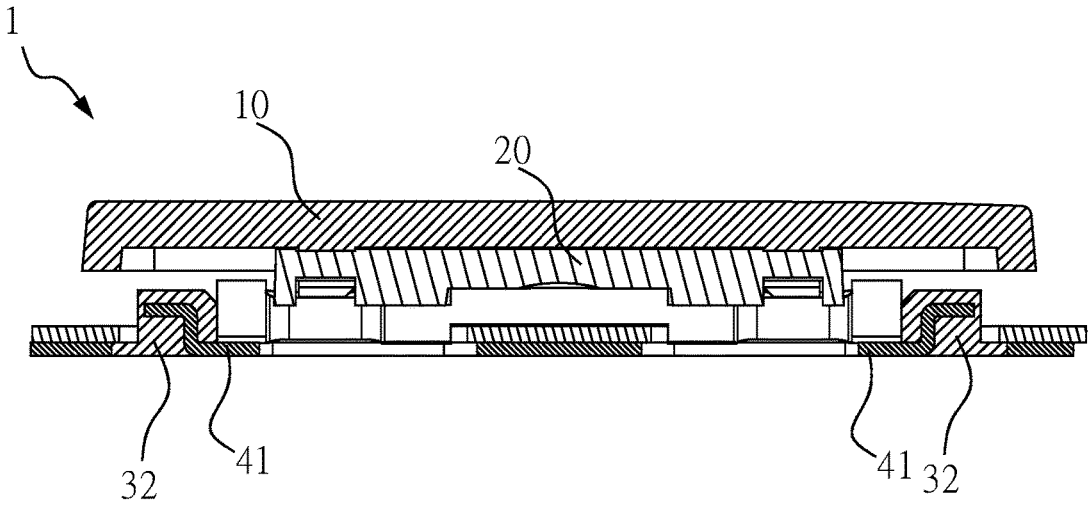
FIG. 3B is a cross-sectional diagram of a key structure according to the first embodiment of the present invention.

As shown in FIG. 2, in this embodiment, the guiding structure 20 includes a plurality of pivot shafts 21, each of which is provided with a corresponding connection member 30 to allow the pivot shaft 21 to be readily joined with the corresponding connection groove 31. It should be noted that, to adapt to the structural configurations of components of the key structure 1 of the present invention, the connection member 30 of this embodiment has two implementation forms 30 and 30*a*, wherein the connection member 30 includes a plurality of connection bodies 32 and the connection member 30*a* includes only a single connection body 32. Meanwhile, the base plate 40 includes a plurality of fixing members 41. As shown in FIG. 3A and FIG. 3B, at least one fixing member 41 or a plurality of fixing members 41 can be embedded in the connection body 32.

As shown in FIG. 2 and FIG. 3A, according to an embodiment of the present invention, the base plate 40 further includes a first through hole 43, which has a first side 431. The fixing member 41 includes a first connecting portion 411 and a second connecting portion 412. The first connecting portion 411 of each fixing member 41 is connected to the first side 431, and the second connecting portion 412 is connected to the first connecting portion 411. In this embodiment, the first connecting portion 411 is perpendicularly connected to the second connecting portion 412 such that the fixing member 41 appears L-shaped. In this embodiment, the connection member 30 includes two connection bodies 32 so as to pivotally provide a pivot shaft 21 at the connection groove 31 between the two connection bodies 32. The first side 431 of the first through hole 43 is provided with two fixing members 41, and the two fixing members 41 are configured in the same direction (the second connecting portions 412 are in an extended arrangement along the same direction). The connection member 30 is provided by means of injection molding at the two fixing members 41, and the two connection bodies 32 respectively envelop the two fixing members 41, thereby reinforcing the strength of the two connection bodies 32 and preventing damage of the connection members 30 when the pivot shaft 21 is assembled or removed. In addition, the connection member 30 completely fills the first through hole 43 during the injection molding process so as to accordingly enhance the strength and evenness of the base plate 40. The connection member 30*a* envelops the single fixing member 41 by means of an injection molding process, such that the pivot shaft 21 can be pivotally rotated and slidably connected to the connection groove 31 of the connection member 30*a*. Since the connection body 32 of the connection member 30*a* envelops the fixing member 41, the strength of the connection member 30*a* is reinforced. It should be noted that the above approach for enveloping the fixing member 41 by the connection member 30 by means of injection molding is different from a fitting or embedding assembly approach; that is, the enveloped component cannot be removed after the injection molding process. Thus, the issue of disengagement of the connection member 30 caused by pressing or pulling of the key can be eliminated.

Figure 4:
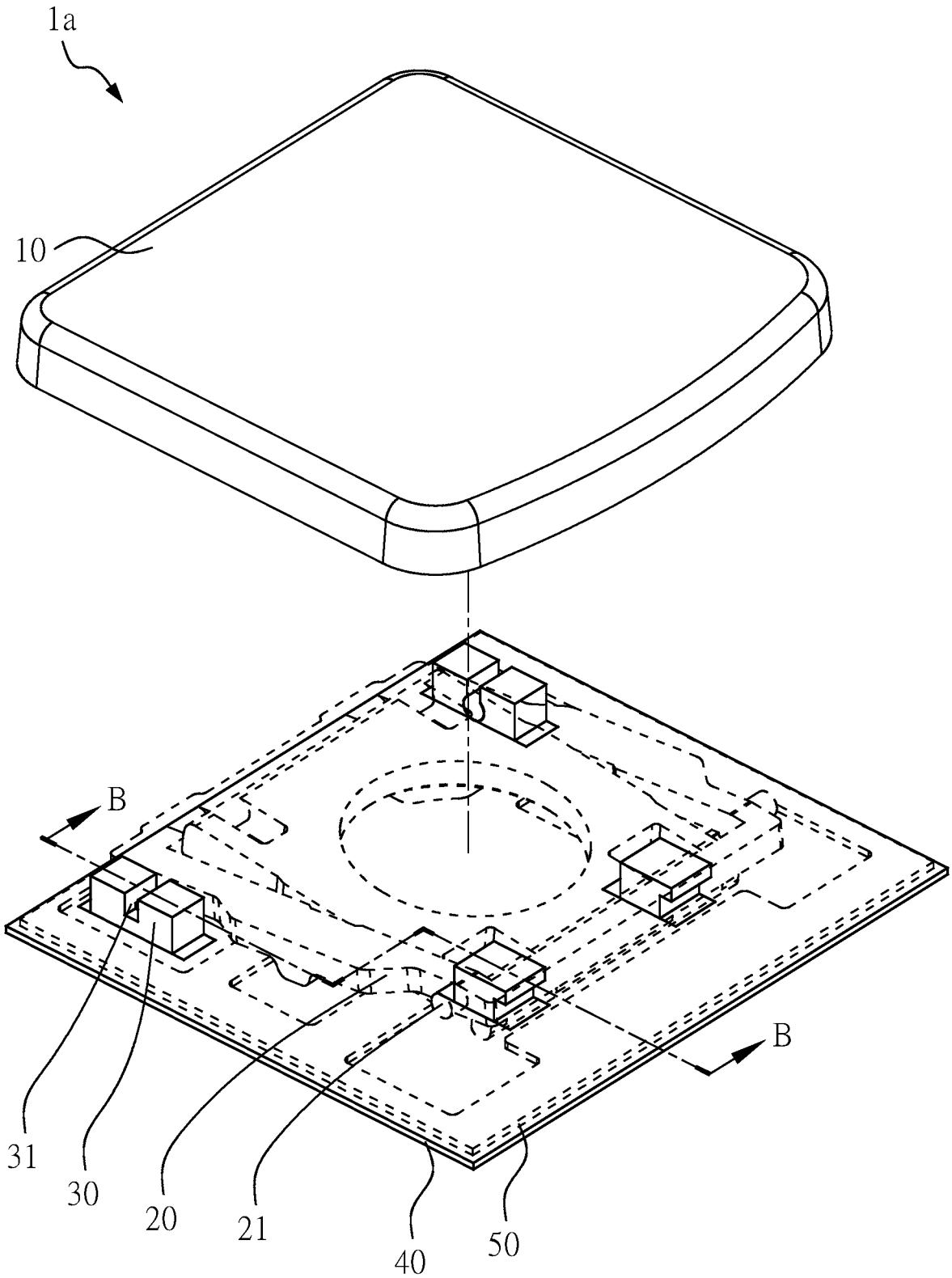
FIG. 4 is a schematic diagram of a key structure according to a second embodiment of the present invention.
Figure 5:
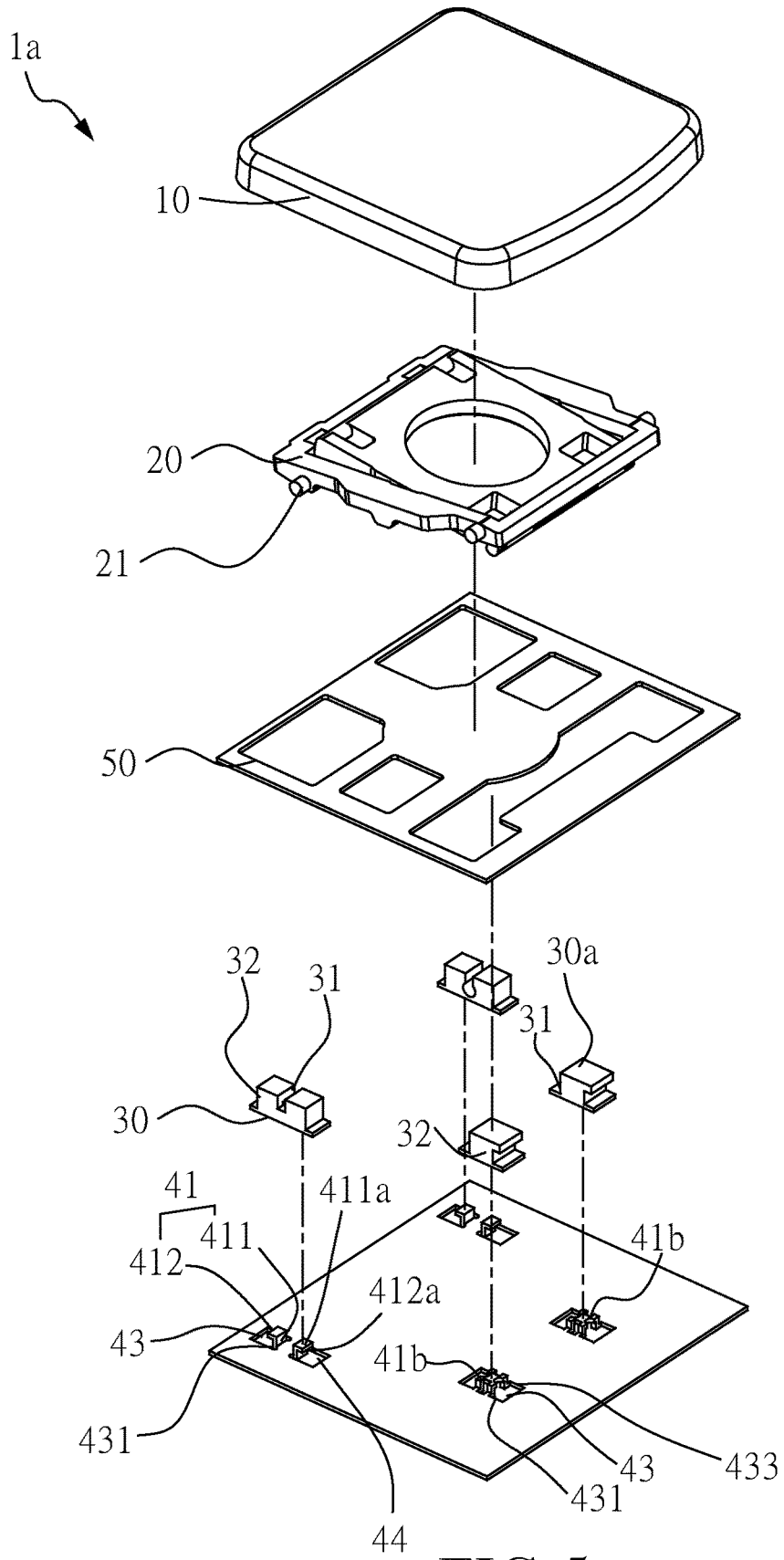
FIG. 5 is an exploded structural diagram of a key structure according to the second embodiment of the present invention.
Figure 6:
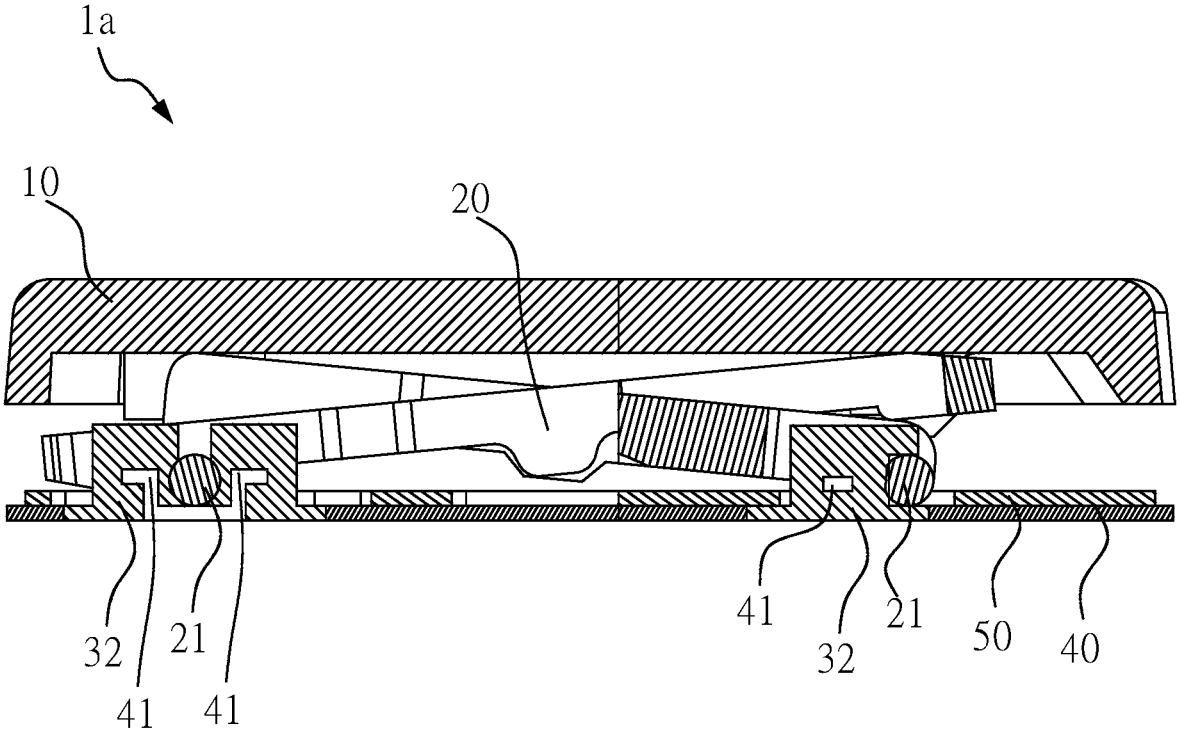
FIG. 6 is a cross-sectional diagram of a key structure along a section line BB in FIG. 4 according to the second embodiment of the present invention.

Refer to FIG. 4 to FIG. 6 for a schematic diagram and an exploded structural diagram of a key structure according to a second embodiment of the present invention, and a cross-sectional diagram of a key structure along a section line BB in FIG. 4 according to the second embodiment of the present invention.

In this embodiment, as shown in FIG. 5, the base plate 40 further includes a second through hole 44, and the fixing member 41 can be L-shaped or inverted-U-shaped (41*b*). When the fixing member 41 is L-shaped, the first connecting portions 411 of two adjacent fixing members 41 are respectively provided at the first through hole 43 and the adjacent side of the second through hole 44. Meanwhile, the second connecting portions 412 of two adjacent fixing members 41 are provided in an extended arrangement along opposite directions, and the two fixing members 41 are respectively enveloped by the two connection bodies 32 by means of injection molding, thereby reinforcing the binding force between the connection member 30 and the base plate 40. As such, the guiding structure 20 is even more unlikely to be disengaged from the base plate 40, thus enhancing the joining stability between the pivot shaft 21 of the guiding structure 20 and the connection groove 31, and minimizing the occurrence of shaking or shifting of the key when the keycap 10 is hit. As shown in FIG. 5, when the fixing member 41*b* is inverted-U-shaped, two opposite sides of the fixing member 41*b* are respectively connected to the first side 431 of the first through hole 43 and a third side 433 of the first through hole 43, wherein the first side 431 and the third side 433 correspond in position to each other. The fixing member 41*b* is enveloped by the connection body 32 of the connection member 30*a* by means of injection molding, thereby reinforcing the strength of the connection member 30*a*.

Figure 7:
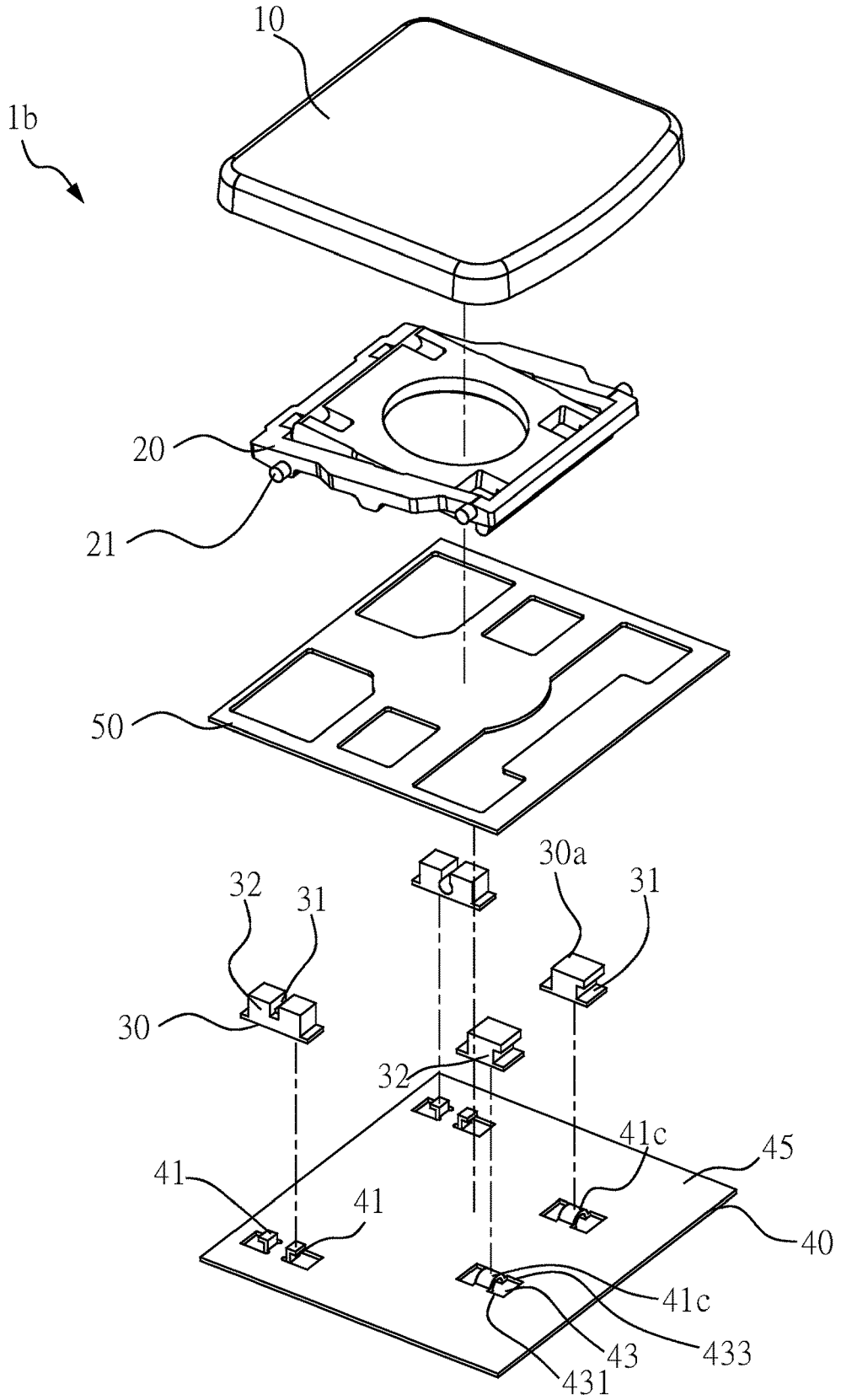
FIG. 7 is an exploded structural diagram of a key structure according to a third embodiment of the present invention.
Figure 8:
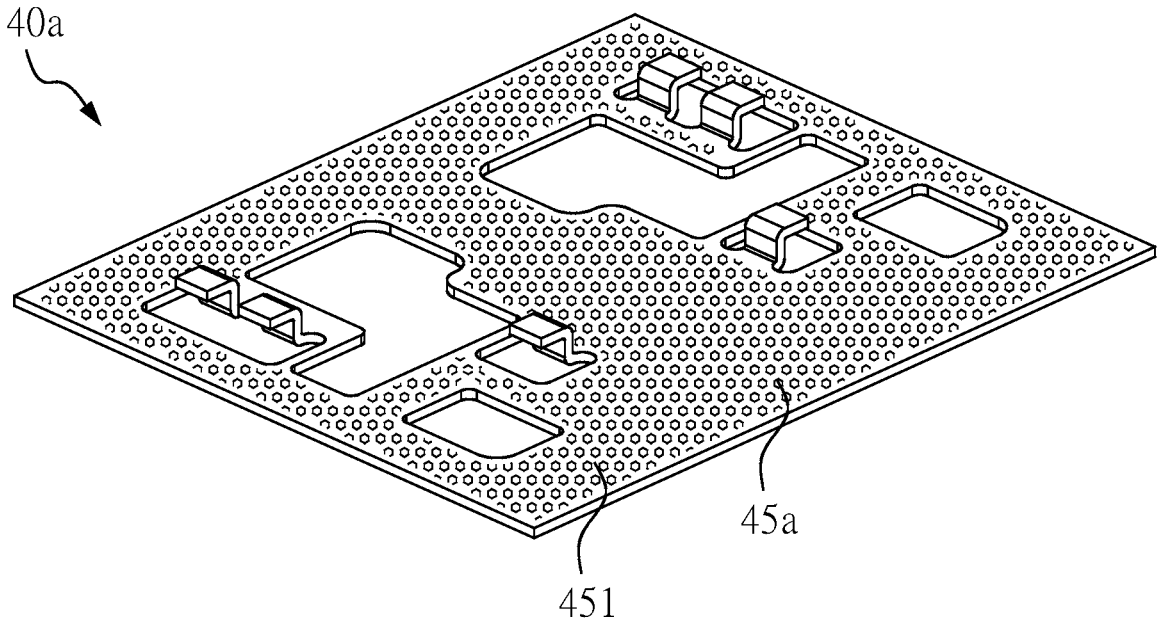
FIG. 8 is a schematic diagram of a base plate according to the second embodiment of the present invention.

Refer to FIG. 7 and FIG. 8 for an exploded structural diagram of a key structure according to a third embodiment of the present invention and a schematic diagram of a base plate according to the second embodiment of the present invention.

As shown in FIG. 7, the fixing member 41 can be L-shaped or arc-shaped (41*c*). When the fixing member 41 is arc-shaped, two opposite sides of the fixing member 41 are respectively connected to the first side 431 of the first through hole 43 and the third side 433 of the first through hole 43. The fixing member 41*c* is enveloped by the connection body 32 of the connection member 30*a* by means of injection molding, thereby reinforcing the strength of the connection member 30*a*.

Furthermore, as shown in FIG. 8, according to an embodiment of the present invention, a surface 45*a* of a base plate 40*a* is processed by mold stamping or undergoes chemical processing to generate a plurality of texture patterns 451, rendering the surface 45*a* to be a rough surface. Thus, friction between the surface 45*a* and the connection member 30 is increased such that the connection member 30 becomes more unlikely to be disengaged from the base plate 40*a* and the joining stability between the pivot shaft 21 of the guiding structure 20 and the connection groove 31 is maintained.

With the fitting force between the fixing member 41 and the connection member 30, the overall structural strength of the key structure 1 is reinforced, and the structural strength between the guiding structure 20 and the base plate 40 is also enhanced to improve the production yield rate of the key structure 1, thereby avoiding the issues of the prior art, namely waste and consequent increases in production costs due to failure to pass the quality control inspection. Meanwhile, with the fitting force between the fixing member 41 and the connection member 30, the joining stability between the pivot shaft 21 of the guiding structure 20 and the connection groove 31 is maintained, hence minimizing the occurrence of shaking or shifting of the key when the keycap 10 is hit. In addition, the fixing member 41 is provided with various implementation forms to adapt to internal designs of the key structure 1, thus enhancing the applicability and flexibility of the present invention.

It should be noted that the above embodiments are merely examples provided for illustration and that the claimed scope of the present invention is defined by the appended claims and not limited to the above embodiments.

What is claimed is:

1. A key structure, comprising:

a keycap;

a guiding structure, connected to the keycap, the guiding structure comprising at least one pivot shaft;

a connection member, comprising a connection groove, wherein the at least one pivot shaft is connected to the connection groove; and a base plate, comprising two fixing members and a first through hole, wherein the connection member envelops the two fixing members such that the connection member is fixed to the base plate, wherein the two fixing members appear L-shaped, the fixing members comprise a first connecting portion and a second connecting portion, the first connecting portions of the two adjacent fixing members are provided at the first through hole, and the second connecting portions of the two adjacent fixing members are provided in an extended arrangement along a same direction.

2. A key structure, comprising:

a keycap;

a guiding structure, connected to the keycap, the guiding structure comprising at least one pivot shaft;

a connection member, comprising a connection groove, wherein the at least one pivot shaft is connected to the connection groove; and a base plate, comprising two fixing members, a first through hole and a second through hole, wherein the connection member envelops the two fixing members such that the connection member is fixed to the base plate, wherein the two fixing members appear L-shaped, the two fixing members comprise a first connecting portion and a second connecting portion, the first connecting portions of the two adjacent fixing members are respectively provided at the first through hole and the second through hole, and the second connecting portions of the two adjacent fixing members are provided in an extended arrangement along opposite directions.

3. A key structure, comprising:

a keycap;

a guiding structure, connected to the keycap, the guiding structure comprising at least one pivot shaft;

a connection member, comprising a connection groove and a plurality of connection bodies, wherein the at least one pivot shaft is connected to the connection groove and the connection groove situated between the plurality of connection bodies; and a base plate, comprising a plurality of fixing member, wherein each of the connection bodies envelops at least one of the plurality of fixing member such that the connection member is fixed to the base plat, wherein the base plate has a surface and a first through hole, at least one of the fixing members is provided on the surface, and the surface has a plurality of texture patterns and the connection member directly contacts with the plurality of texture patterns when a size of a bottom surface of the connector members is larger than a size of the first through hole to accordingly increase friction between the surface and the connection member.

4. The key structure according to claim 3, wherein the plurality of texture patterns are generated by mold stamping or chemical processing.

* * * * *